US011495370B2

(12) United States Patent
Goertzen et al.

(10) Patent No.: US 11,495,370 B2
(45) Date of Patent: Nov. 8, 2022

(54) THERMAL EXPANSION AND SWELL COMPENSATED JACKET FOR ESP CABLE

(71) Applicant: Schlumberger Technology Corporation, Sugar Land, TX (US)

(72) Inventors: William Goertzen, Lawrence, KS (US); Adan Lau, Lawrence, KS (US); Patrick Zhiyuan Ma, Lawrence, KS (US); Mark A. Metzger, Lawrence, KS (US); James Crowder, Lawrence, KS (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/169,018

(22) Filed: Feb. 5, 2021

(65) Prior Publication Data

US 2021/0249155 A1 Aug. 12, 2021

Related U.S. Application Data

(60) Provisional application No. 62/971,085, filed on Feb. 6, 2020.

(51) Int. Cl.

| | |
|---|---|
| ***H01B 7/28*** | (2006.01) |
| ***H01B 13/14*** | (2006.01) |
| ***H01B 7/02*** | (2006.01) |
| ***H01B 7/08*** | (2006.01) |

(52) U.S. Cl.

CPC ..... *H01B 7/2806* (2013.01); *H01B 7/0216* (2013.01); *H01B 7/08* (2013.01); *H01B 13/14* (2013.01)

(58) Field of Classification Search

CPC ..... H01B 7/02; H01B 7/04; H01B 7/0823; H01B 7/0838; H01B 7/0846; H01B 7/0869; H01B 7/0892; H01B 7/18; H01B 7/181; H01B 7/184; H01B 7/1845; H01B 7/187; H01B 7/28; H01B 7/29; H01B 7/36; H01B 7/361; H01B 7/363; H01B 7/365; H01B 7/385; H01B 9/02; H01B 9/04; H01B 9/06; H01B 9/0605; H01B 9/0611

USPC ..... 174/110 R, 112, 113 R, 113 C, 117 R, 174/117 F, 117 FF

See application file for complete search history.

(56) References Cited

U.S. PATENT DOCUMENTS

| | | | | |
|---|---|---|---|---|
| 2,583,026 A * | 1/1952 | Swift | ..... | H01B 7/188 174/117 R |
| 5,431,759 A * | 7/1995 | Neuroth | ..... | H01B 13/14 264/177.17 |
| 5,990,419 A * | 11/1999 | Bogese, II | ..... | H01B 11/002 174/120 R |

(Continued)

FOREIGN PATENT DOCUMENTS

| | | | | |
|---|---|---|---|---|
| EP | 2615240 A2 * | 7/2013 | ..... | H01B 7/04 |
| FR | 1111626 A2 * | 12/2000 | ..... | H01B 7/18 |
| WO | WO2016/089717 A1 * | 6/2016 | ..... | H01B 7/17 |

*Primary Examiner* — William H. Mayo, III

(57) ABSTRACT

A cable includes insulated conductors arranged in a spaced apart generally coplanar configuration. A jacket encapsulates the insulated conductors. The jacket has a generally rounded rectangular cross-section, at least one spline along a minor edge of the jacket, and at least one channel along a major edge. An armor layer is applied about the jacket.

16 Claims, 7 Drawing Sheets

(56) References Cited

U.S. PATENT DOCUMENTS

| | | | | |
|---|---|---|---|---|
| 6,815,617 | B1 * | 11/2004 | Gebs | H01B 11/1834 174/102 R |
| 6,914,193 | B2 * | 7/2005 | Ware | H01B 7/184 174/11 OR |
| 7,135,641 | B2 * | 11/2006 | Clark | H01B 7/184 174/11 OR |
| 7,145,080 | B1 * | 12/2006 | Boisvert | H01B 11/06 174/11 OR |
| 7,550,674 | B2 * | 6/2009 | Jean | H01B 11/04 174/11 OR |
| 7,560,646 | B2 * | 7/2009 | Heffner | H01B 13/143 174/11 OR |
| 9,245,669 | B2 * | 1/2016 | Glew | G02B 6/4434 |

* cited by examiner

THERMAL EXPANSION AND SWELL COMPENSATED JACKET FOR ESP CABLE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/971,085, filed Feb. 6, 2020, the entirety of which is incorporated by reference herein and should be considered part of this specification.

BACKGROUND

Field

The present disclosure generally relates to cables for use with electric submersible pumps (ESPs), and more particularly to ESP cables having a flat design.

Description of the Related Art

In many hydrocarbon well applications, power cables are employed to deliver electric power to various devices. For example, power cables may be used to deliver electric power to electric submersible pumping systems, which may be deployed downhole in wellbores. The power cables are subjected to harsh working environments containing corrosives, e.g., corrosive gases, elevated temperatures, high pressures, and vibrations. Additionally, the power cables may be used in a variety of applications having limited space available.

SUMMARY

In some configurations, a cable of the present disclosure may include insulated conductors arranged in a spaced apart generally coplanar configuration, a jacket encapsulating the insulated conductors and having a generally rounded rectangular cross-section and at least one spline along a minor edge of the jacket and at least one channel along a major edge, and an armor layer applied about the jacket.

The jacket can include splines on both minor edges. At least one spline can be an orientation spline. The orientation spline can be wider than any other spline. A major edge of the jacket can be at least two-and-a-half times a length of a minor edge of the jacket. The jacket can includes channels on both major edges.

In some configurations, a cable includes a plurality of conductors arranged in a side-by-side configuration; a layer of insulation surrounding each of the plurality of conductors; a jacket disposed about and surrounding the layers of insulation, the jacket having a generally rounded rectangular transverse cross-sectional shape having generally straight major sides and curved minor sides, the jacket further comprising at least one spline projecting radially outward from at least one of the curved minor sides; and an armor layer disposed about the jacket.

The at least one spline can be a plurality of splines projecting radially outward from each of the curved minor sides. The cable can further include an orientation spline projecting radially outward from one of the curved minor sides. The orientation spline can have a different size and/or shape than the at least one spline. For example, the orientation spline can be wider than the at least one spline. The cable can further include at least one channel formed in at least one of the major sides of the jacket. The at least one channel can include at least one channel formed in each of the major sides of the jacket. The cable can have three conductors.

In some configurations, a method for manufacturing a cable can include disposing an insulation layer about each of a plurality of conductors; aligning the insulated conductors in a side-by-side configuration; extruding a jacket about the insulated conductors; forming one or more splines of the jacket protruding radially outwardly from a remainder of the jacket; and applying an armor layer about the jacket.

The one or more splines can be formed while extruding the jacket about the insulated conductors or during a post-extrusion operation. The jacket can be extruded to form a generally curved rectangular transverse cross-section having generally straight major sides and curved minor sides, and the one or more splines can be formed on the minor sides. The method can further include forming one or more channels in an outer surface of the jacket. The one or more channels can be formed while extruding the jacket or during a post-extrusion operation. The one or more channels can be formed in the major sides of the jacket.

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limited the scope of the claimed subject matter.

BRIEF DESCRIPTION OF THE FIGURES

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
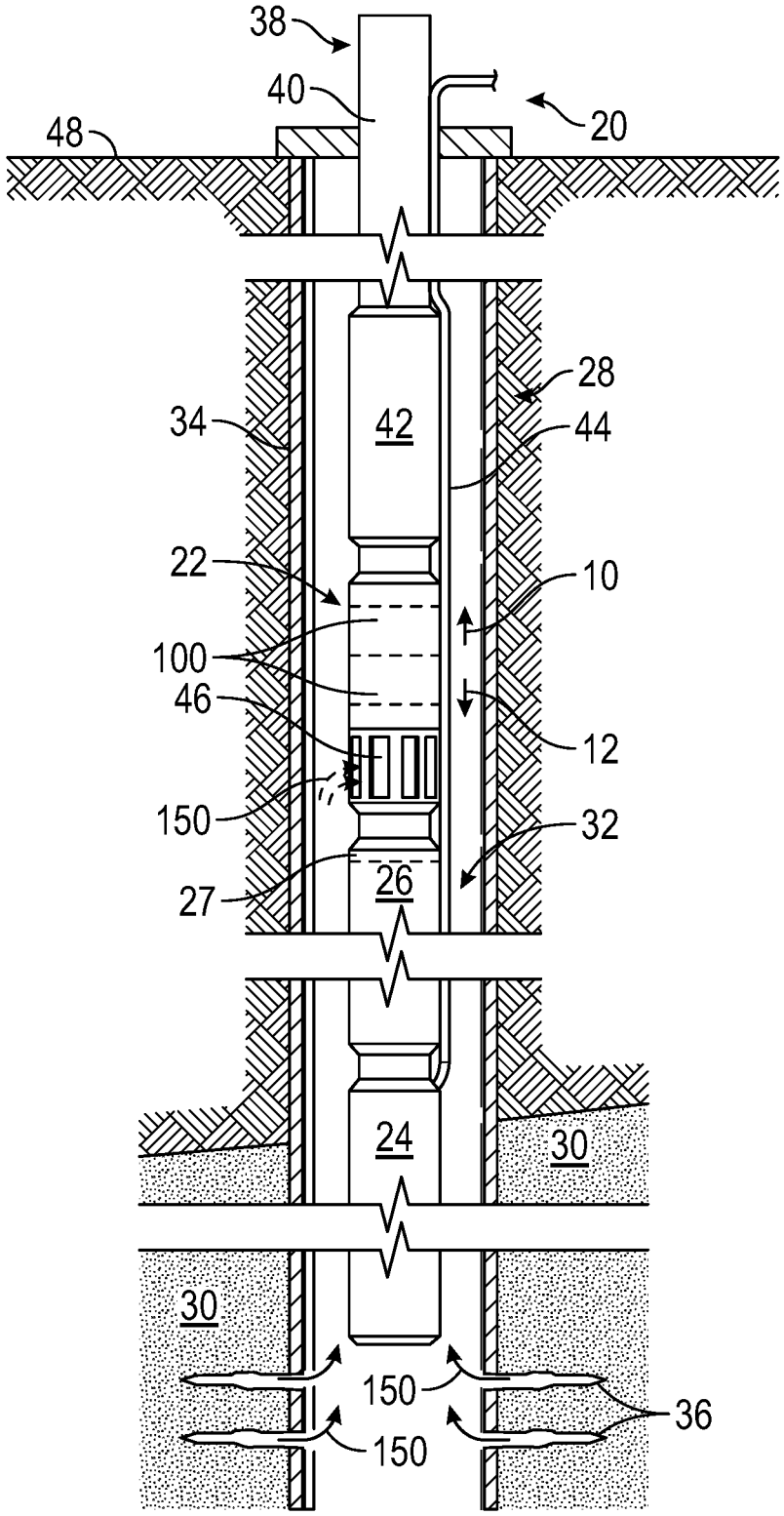
FIG. 1 is an illustration of an example electric submersible pumping system installation, according to an embodiment of the disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The present disclosure advantageously provides a damage-resistant ESP cable. Some previous non-lead, flat ESP cables included multiple elastomeric jacket layers for protection from well fluids. However, without constraint, individual elastomer jacket layers could swell in well fluids and gas, causing damage due to distortion or rapid gas decompression (RGD) during pull out. Some previous cables had a "Superflat" jacket, in which one solid jacket overlies three flat conductors to fully encapsulate the insulated conductors and reduce damage. However, the jacket could be damaged during an armoring process or during cold bending at installation, and the "Superflat" construction can be difficult to manufacture.

Cables according to the present disclosure advantageously address these issues. In some configurations, the present disclosure generally relates to a flat cable design having asymmetric splines on a jacket layer. The splines can advantageously protect the jacket during armoring, aid in manufacturing by providing an indicator of when the extrusion die is fully filled, and/or indicate an orientation of the jacket for manufacturing purposes and phase identification during deployment.

FIG. 1 illustrates an electrical submersible pump system 20 deployed in a well 28. Submersible pumping system 20 may comprise a variety of components depending on the particular application or environment in which it is used. The illustrated pumping system 20 includes a pump 22 coupled to an electric motor 24 and a motor protector 26. Pump 22 may include two or more stages 100, e.g., compression stages. Each stage includes a rotating impeller and a stationary diffuser. The pump stages are characterized by the angle of flow passages in the impellers. The stages may be radial flow, mixed flow, or axial flow. The net thrust load, e.g. downthrust load, resulting from rotation of the impellers may be resisted by a bearing 27 illustrated in FIG. 1 in motor protector 26. For the purpose of clarity, arrow 10 indicates the direction of upthrust and an arrow 12 indicates the direction of downthrust.

Well 28 includes a wellbore 32 drilled into a geological formation 30 containing, for example, a desirable production fluid 150, such as petroleum. Wellbore 32 may be lined with a tubular casing 34. Perforations 36 are formed through wellbore casing 34 to enable flow of fluids between the surrounding formation 30 and the wellbore 32. Submersible pumping system 20 is deployed in wellbore 32 by a deployment system 38 that may have a variety of configurations. For example, deployment system 38 may comprise tubing 40, such as coiled tubing or production tubing, connected to submersible pump 22 by a connector 42. Power may be provided to the submersible motor 24 via a power cable 44. The submersible motor 24, in turn, powers submersible pump 22, which can be used to draw in production fluid 150 through a pump intake 46. Within submersible pump 22, a plurality of impellers are rotated to pump or produce the production fluid 150 through, for example, tubing 40 to a desired collection location which may be at a surface 48 of the Earth.

Figure 2:
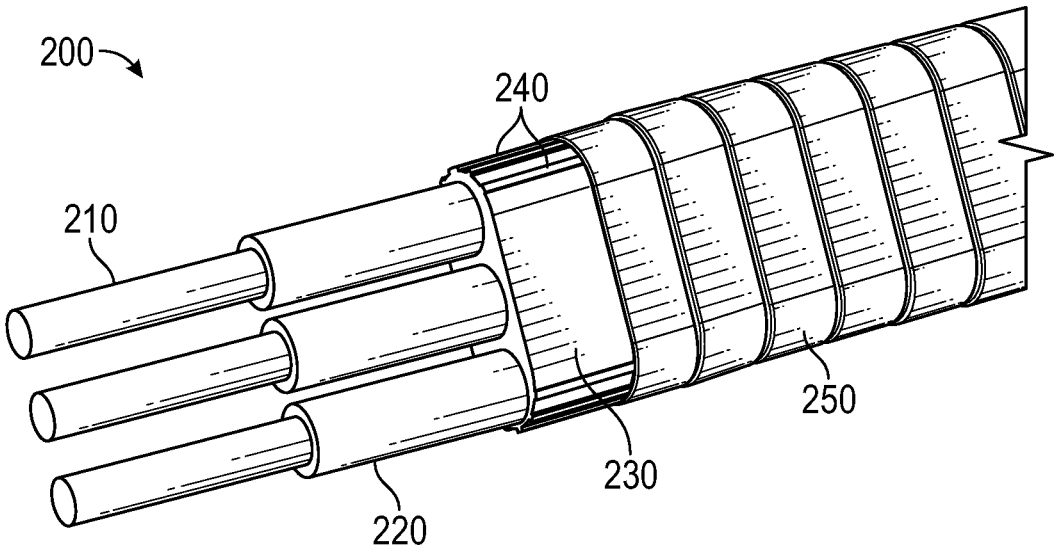
FIG. 2 is a partial perspective view of an example cable, according to an embodiment of the disclosure.

Referring generally to FIG. 2, a cable 200 is presented according to an embodiment of the disclosure. The cable 200 includes three conductors 210, each coated by a layer of insulation 220. The insulated conductors 210 are arranged in a spaced side-by-side (i.e., flat or generally co-planar) configuration. A jacket 230 covers the three insulated conductors 210. The jacket 230 includes a plurality of splines 240 on at least a portion of the exterior of the jacket 230. An armor layer 250 overlies or is disposed about the jacket 240.

Figure 3:
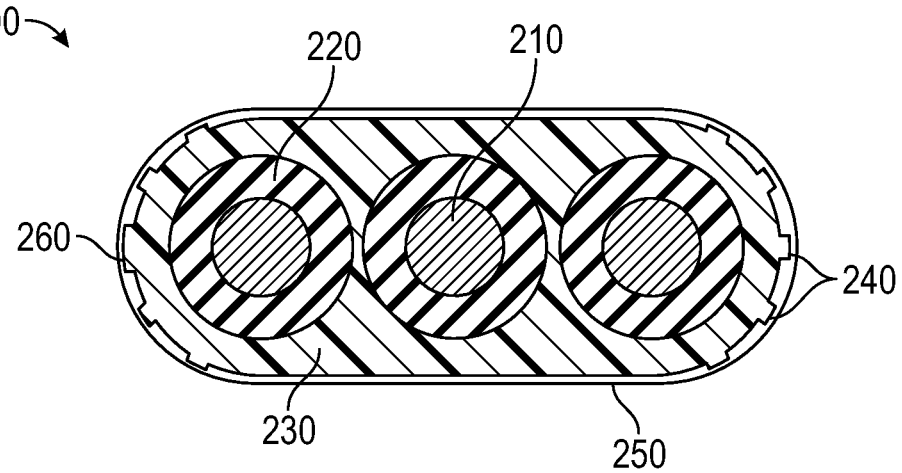
FIG. 3 is an illustration of a cross-sectional view of an example cable, according to an embodiment of the disclosure.

Referring generally to FIG. 3, a cross-sectional view of a cable 300 is presented according to an embodiment of the disclosure. The cable 300 includes three insulated conductors encapsulated within jacket 230. Each insulated conductor is formed from a conductor 210 and an insulation layer 220. Portions of the exterior of the jacket 230 include splines 240. The splines 240 project radially outwardly from or extend outwardly to a greater extent than a remainder of the exterior of the jacket 230. The splines 240 can extend longitudinally along a portion or entirety of a length of the cable. The splines 240 may be placed along minor edges or sides of the jacket body. In other words, the cross-sectional shape of the cable 300 (as shown in, for example, FIG. 3) can be generally rectangular with rounded or curved minor, or shorter, sides, and the splines 240 can be placed along the rounded or curved minor or shorter sides. One of the splines may be an orientation spline 260. In some configurations, the orientation spline 260 is larger and/or has a different shape than the other splines 240 to distinguish the orientation spline 260. The orientation spline 260 may provide a reference point for use in subsequent manufacturing operations, such as, but not limited to, the armoring process, or to aid in phase identification by knowing which conductor is proximate the orientation spline 260. Cable 300 may also include armor layer 250 about the exterior of jacket 230. In some configurations, the armor layer 250 is in contact with the splines 240 and/or orientation spline 260.

The splines 240, 260 advantageously protect the jacket 230 by creating cushions in the area of the jacket 230 where the stress placed on the jacket 230 is highest. In use, during wrapping or bending upon use of the cable on location, edges of the armor 250 strap can dig into the jacket 230 and create small tears. This can be a significant problem, particularly during cold bending at location (e.g., at temperatures at which stiffness of the elastomer jacket 230 increases). If the jacket 230 is torn, well fluid can enter and reach the exposed insulation material, potentially significantly reducing the cable life. The splines 240, 260 create cushions that can absorb stress and/or tears caused by the armor 250, thereby protecting the remainder of the jacket 230 and the underlying insulation.

The splines 240, 260 can also aid in manufacturing by providing the operator with an improved view of the edge of the jacket 230 in the sight glass for a CV (continuous vulcanization) steam tube. If the die is underfilled, the spline 240, 260 edges will not be filled, but when the die is full, the spline 240, 260 edges are evident. The asymmetric nature of the jacket 230, with the orientation spline 260 having a different size and/or shape than the other splines 240, provides an indication of orientation during manufacturing and during deployment for phase identification. The splines 240, 260 can also or alternatively help the armor 250 grip the cable to reduce or minimize axial sliding during handling or deployment. The splines 240, 260 can be oriented and spaced to add minimal material usage to the design, provide adequate protection, and avoid increasing the minor operational diameter of the cable.

Figure 4A:
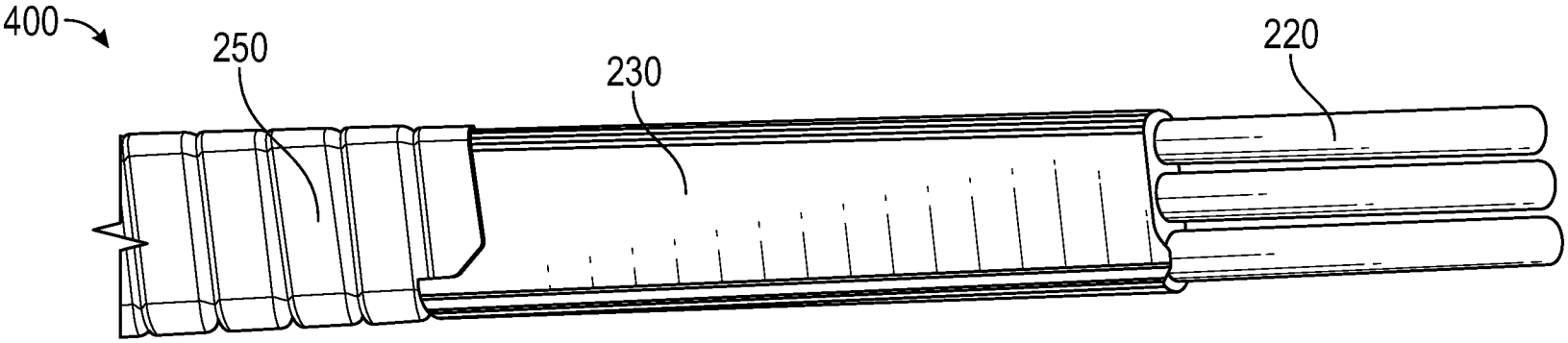
FIG. 4A shows an example cable, according to an embodiment of the disclosure.

Referring generally to FIG. 4A, a cable 400 according to an embodiment of the disclosure is presented. The cable 400 includes three conductors coated by insulation 220. The insulated conductors are configured in a flat, in-line, or side-by-side arrangement. Jacket 230 covers the three insulated conductors. Armor layer 250 is wrapped around jacket 230.

Figure 4C:
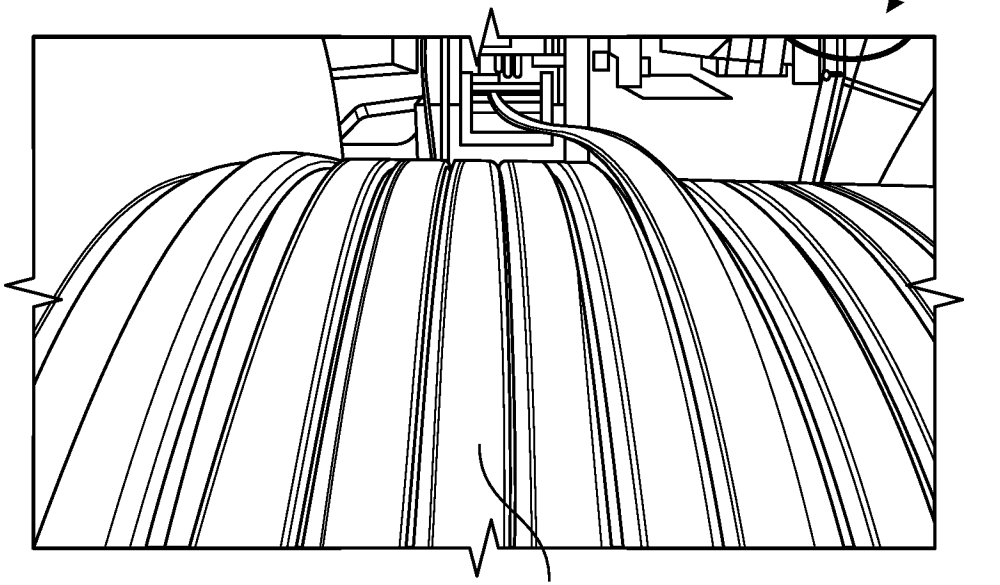
FIG. 4C shows an extrusion process forming the cable component of FIG. 4B, according to an embodiment of the disclosure.
Figure 4B:
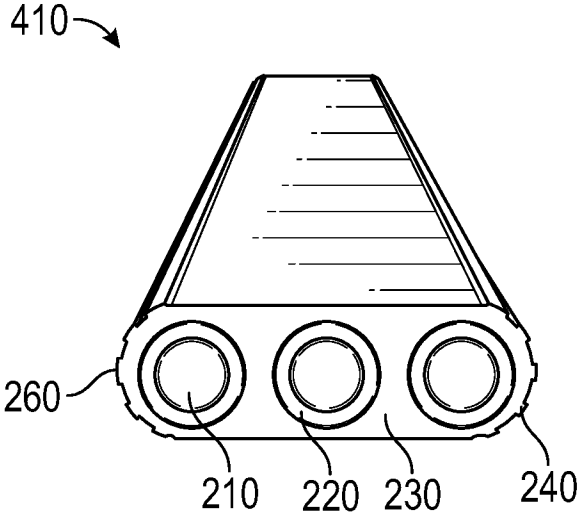
FIG. 4B is a cross-sectional view of a component of the cable of FIG. 4A, according to an embodiment of the disclosure.

Referring generally to FIG. 4B, a cross-sectional view of a component 410 of a cable according to an embodiment of the disclosure is presented. The cross-section shows the spaced side-by-side configuration of the insulated conductors 210/220, the generally rounded rectangle cross-section of the jacket 230, the splines 240 disposed along the minor edges of the jacket 230, and orientation spline 260.

FIG. 4C shows jacket 230 being applied over the conductors by extrusion process 420.

Figure 5:
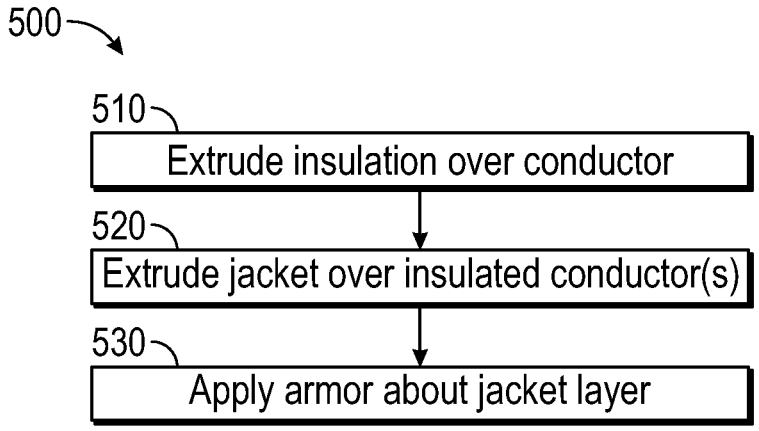
FIG. 5 is a flow diagram of a method for constructing a cable, according to an embodiment of the disclosure.

Referring generally to FIG. 5, a method 500 for constructing a cable is outlined, according to an embodiment of the disclosure. An insulation layer is extruded over a conductor at step 510. A jacket layer is extruded over one or more insulated conductors at step 520. In some embodiments of the disclosure, three insulated conductors may be used; however the number may be varied and includes 1, 2, 4, 5, or more insulated conductors. Splines on the exterior of the jacket may be formed during the extrusion process 520 or formed during a post-extrusion operation. Channels on the exterior of the jacket, for example, as shown in and described in greater detail with respect to FIGS. 6-7H, may be formed during the extrusion process 520 or formed during a post-extrusion operation. An armor layer is applied over the jacket layer at step 530 to complete the cable.

Figure 6:
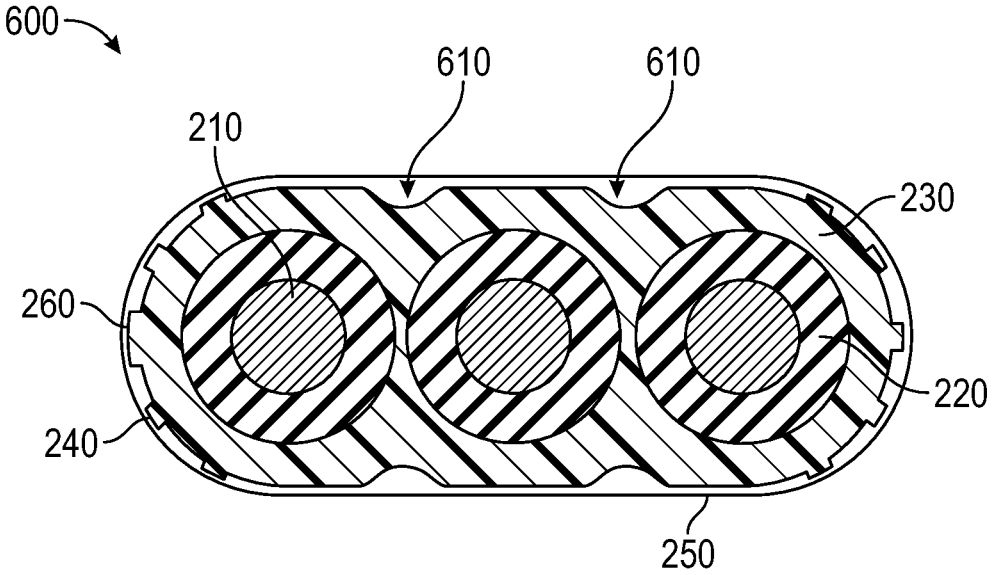
FIG. 6 is an illustration of a cross-sectional view of an example cable, according to an embodiment of the disclosure.

Referring generally to FIG. 6, a cross-sectional view of cable 600, according to an embodiment of the disclosure, is provided. The cable 600 includes three insulated conductors encapsulated within jacket 230. Each insulated conductor is formed from a conductor 210 and an insulation layer 220. Portions along minor edges or sides of the exterior of the jacket 230 include splines 240. One of the splines may be an orientation spline 260. The orientation spline 260 may provide a reference point for use in subsequent manufacturing operations, such as, but not limited to, the armoring process, or to aid in phase identification by knowing which conductor is proximate the orientation spline. Portions along major, or longer, edges or sides (e.g., when viewing the cable in transverse cross-section as shown in FIG. 6) of the exterior of the jacket may include one or more channels 610. The channels 610 can extend longitudinally along a portion or entirety of the length of the cable 600. Cable 600 may also include armor layer 250 about the exterior of jacket 230.

The channel(s) 610 can act as material-removing or material-reducing features. Among the many functions that the channels 610 may serve, the channel(s) 610 may allow for thermal expansion and/or fluid swell of the jacket material, which can help reduce or mitigate internal stresses on the conductors and reduce or prevent swelling of the jacket against the internal surface of the armor layer. Channel(s) 610 may also serve as alignment aids during splicing operations. The channel(s) 610 can reduce stress concentrations, optimize expansion space based on fluid swell and thermal expansion, facilitate termination for splicing, and/or improve or optimize cost reduction (for example, by reducing material used in the jacket and keeping armor material usage constant). The channel(s) 610 can also assist in manufacturing by indicating overfilling of the die if the channel(s) 610 become less pronounced or filled with material during manufacturing. As channel(s) 610 can help the jacket be RGD resistant due to the continuous nature of the jacket and limited free interstitial space.

Figure 7A:
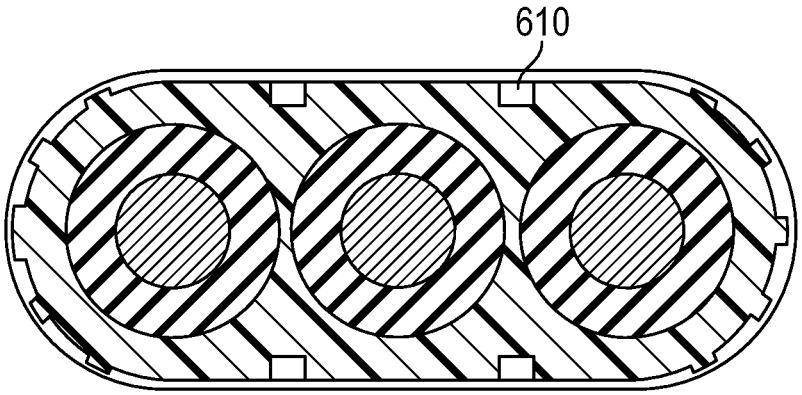
FIG. 7A is an illustration of a cross-sectional view of an example cable, according to an embodiment of the disclosure.
Figure 7B:
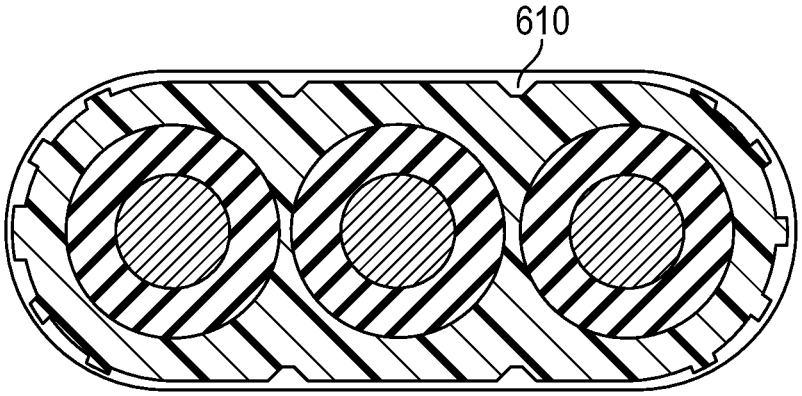
FIG. 7B is an illustration of a cross-sectional view of an example cable, according to an embodiment of the disclosure.
Figure 7C:
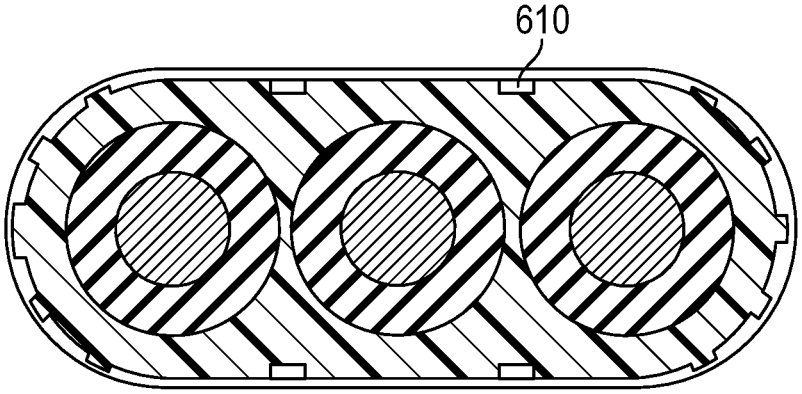
FIG. 7C is an illustration of a cross-sectional view of an example cable, according to an embodiment of the disclosure.
Figure 7D:
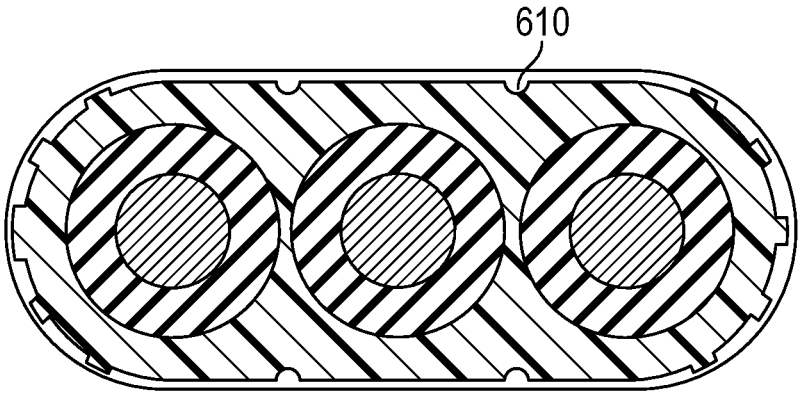
FIG. 7D is an illustration of a cross-sectional view of an example cable, according to an embodiment of the disclosure.
Figure 7E:
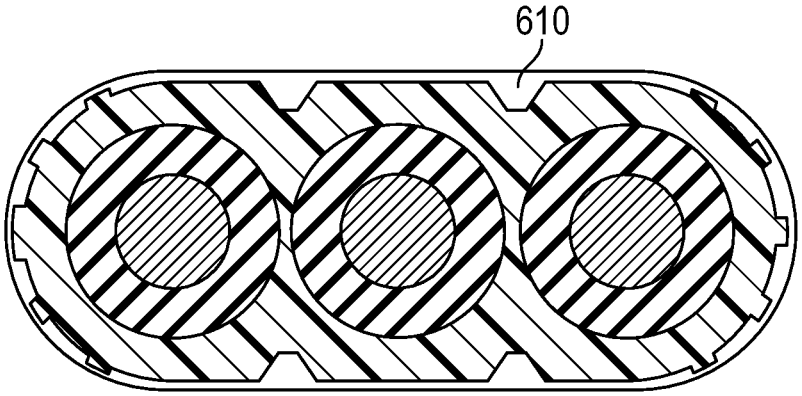
FIG. 7E is an illustration of a cross-sectional view of an example cable, according to an embodiment of the disclosure.
Figure 7F:
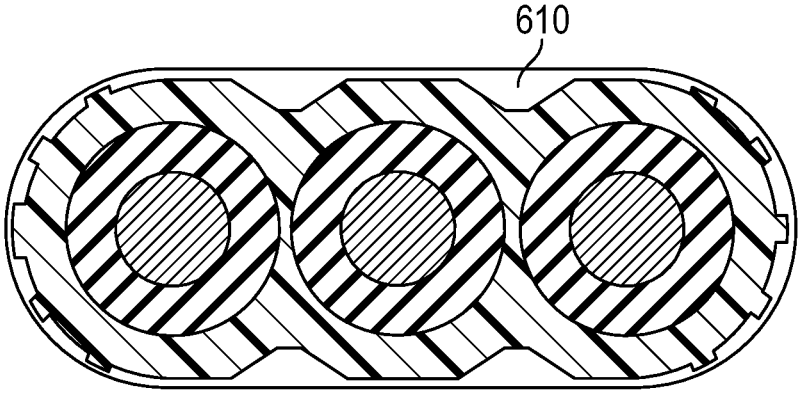
FIG. 7F is an illustration of a cross-sectional view of an example cable, according to an embodiment of the disclosure.
Figure 7G:
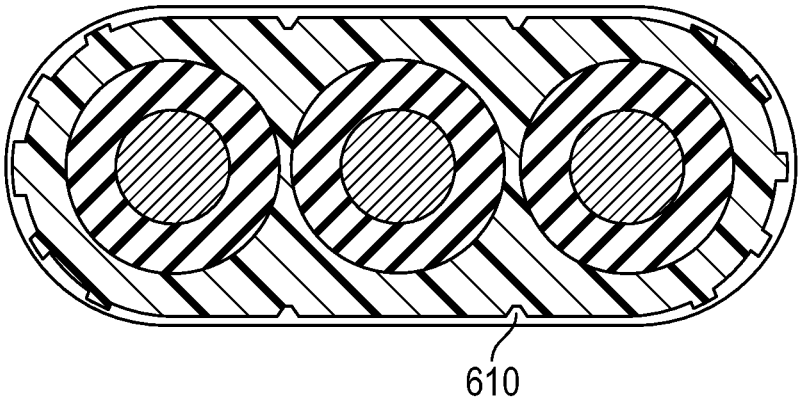
FIG. 7G is an illustration of a cross-sectional view of an example cable, according to an embodiment of the disclosure.
Figure 7H:
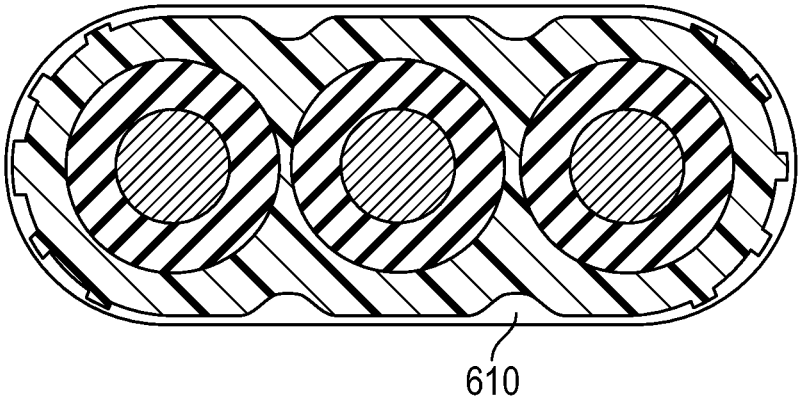
FIG. 7H is an illustration of a cross-sectional view of an example cable, according to an embodiment of the disclosure.

Referring generally to FIGS. 7A-7H, a variety of channels 610 are shown. As shown, the channels 610 can have a variety of sizes and configurations or shapes. The various sizes and configurations of the channel(s) 610 can be selected to improve or optimize cost reduction, space for thermal expansion, space for fluid swell, RGD resistance, splice termination ease, and/or extrusion processability. FIG. 7A presents a channel with a rectangular cross-section. FIG. 7B presents a channel with a semi-circle cross-section. FIG. 7C presents a channel with a rectangular cross-section. FIG. 7D presents a channel with a semi-circle cross-section. FIG. 7E presents a channel with a generally triangular cross-section. FIG. 7F presents a channel with a generally triangular cross-section. FIG. 7G presents a channel with a generally triangular cross-section. FIG. 7H presents a channel with a generally triangular cross-section.

In some embodiments of the disclosure, one or more splines are disposed along the length of the cable on the jacket. In some embodiments of the disclosure, the jacket has a generally rounded rectangular cross-sectional shape. In such embodiments, the jacket has two opposing major edges (or sides) and two opposing minor edges (or sides), a major edge (or side) being longer than a minor edge (or side). In some embodiments having a generally rounded rectangular cross-sectional shaped jacket, the splines are disposed along the length of the cable on at least one of the minor edges. In some such embodiments, the splines are disposed on both minor edges. In some embodiments of the disclosure, the splines may have a width (e.g., measured in a direction in the plane of the transverse cross-section and/or along a circumference of the jacket) in the range of from about 0.030" to about 0.090" and a height (e.g., measured in a radial direction from a base of the spline (or the exterior surface of a remainder of the jacket) radially outwardly to the radially outermost edge of the spline) in the range of from about 0.010" to about 0.030". In some embodiments, of the disclosure, the splines are disposed on the edges of the jacket in the major axis only. In some embodiments, the splines have different dimensions from one another. In some embodiments of the disclosure, the splines all have the same dimensions as one another. In some embodiments, of the disclosure, the orientation spline 260 is wider than the splines 240. In some embodiments of the disclosure, the orientation spline 260 is bigger than the splines 240. In some embodiments of the disclosure, the orientation spline is at least twice as wide as any other spline. In some embodiments of the disclosure, the jacket may have a width that is greater than about two-and-a-half times its height. In some embodiments of the disclosure, the splines protect the integrity of the jacket during the armoring process. In some embodiments of the disclosure, the splines protect the integrity of the jacket from impingement by the armor from being the cable during use. In some embodiments of the disclosure, the jacket is subjected to a continuous vulcanization steam tube before the armoring process. In some embodiments of the disclosure, the jacket may comprise EPDM. In some embodiments of the disclosure, the jacket may comprise nitrile (NBR).

In some embodiments of the disclosure, there is a channel disposed along the length of the cable on the jacket. In some embodiments of the disclosure, there is a channel disposed along the length of the cable on each major edge of the jacket between insulated conductors. For example, in a three insulated conductor cable there may be four channels. In some embodiments of the disclosure, each channel may have a unique shape. In some embodiments of the disclosure, each channel may be the same shape as the other channels. In some embodiments of the disclosure, each channel may be of the same general shape but of differing sizes.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A flat cable comprising:

a plurality of insulated conductors arranged in a spaced apart generally co-planar configuration;

a jacket encapsulating the plurality of insulated conductors, the jacket having a generally rounded rectangular cross-section defining a pair of opposing major edges and a pair of opposing minor edges, the jacket comprising at least one spline disposed on only each minor edge and a channel disposed only in each major edge between each pair of neighboring insulated conductors; and an armor layer surrounding the jacket.

2. The flat cable according to claim 1 wherein the jacket comprises splines on both minor edges.

3. The flat cable according to claim 1 wherein at least one spline is an orientation spline.

4. The flat cable according to claim 3 wherein the orientation spline is wider than any other spline.

5. The flat cable according to claim 1 wherein a major edge of the jacket is at least two-and-a-half times the length of a minor edge of the jacket.

6. A method for manufacturing a cable, the method comprising:

disposing an insulation layer about each of a plurality of conductors;

aligning the insulated conductors in a side-by-side configuration;

extruding a jacket about the insulated conductors;

forming one or more splines of the jacket protruding radially outwardly from [a remainder] only the curved minor sides of the jacket;

forming one or more channels in an outer surface of the jacket only in the generally straight major sides, each channel disposed between neighboring insulated conductors; and applying an armor layer about the jacket.

7. The flat cable according to claim 1 wherein the jacket comprises channels on both major edges.

8. A cable comprising:

a plurality of conductors arranged in a side-by-side configuration;

a layer of insulation surrounding each of the plurality of conductors;

a jacket disposed about and surrounding the layers of insulation, the jacket having a generally rounded rectangular transverse cross-sectional shape having generally straight major sides and curved minor sides, the jacket further comprising a plurality of splines projecting radially outward from only the curved minor sides and a plurality of channels disposed only in the generally straight major sides; and an armor layer disposed about the jacket.

9. The cable of claim 8, further comprising an orientation spline projecting radially outward from one of the curved minor sides.

10. The cable of claim 9, wherein the orientation spline has a different size and/or shape than the plurality of splines.

11. The cable of claim 10, wherein the orientation spline is wider than the plurality of splines.

12. The cable of claim 8, the plurality of conductors comprising three conductors.

13. The method of claim 6, wherein the jacket is extruded to form a generally curved rectangular transverse cross-section having generally straight major sides and curved minor sides, and wherein the one or more channels are formed in the major sides of the jacket.

14. The method of claim 6, wherein the one or more splines are formed while extruding the jacket about the insulated conductors.

15. The method of claim 6, wherein the one or more splines are formed during a post-extrusion operation.

16. The method of claim 6, wherein the jacket is extruded to form a generally curved rectangular transverse cross-section having generally straight major sides and curved minor sides, and wherein the one or more splines are formed on the minor sides.

* * * * *